US011290835B2

(12) United States Patent
Nakagawa et al.

(10) Patent No.: US 11,290,835 B2
(45) Date of Patent: Mar. 29, 2022

(54) ACOUSTIC PROCESSING APPARATUS, ACOUSTIC PROCESSING METHOD, AND PROGRAM

(71) Applicant: Sony Corporation, Tokyo (JP)

(72) Inventors: Toru Nakagawa, Chiba (JP); Ryutaro Watanabe, Tokyo (JP); Tetsunori Itabashi, Kanagawa (JP); Shigetoshi Hayashi, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/964,121

(22) PCT Filed: Nov. 30, 2018

(86) PCT No.: PCT/JP2018/044214
§ 371 (c)(1),
(2) Date: Jul. 22, 2020

(87) PCT Pub. No.: WO2019/146254
PCT Pub. Date: Aug. 1, 2019

(65) Prior Publication Data

US 2021/0037333 A1 Feb. 4, 2021

(30) Foreign Application Priority Data

Jan. 29, 2018 (JP) ..... JP2018-012636

(51) Int. Cl.
*H04S 7/00* (2006.01)
*H04R 5/02* (2006.01)

(52) U.S. Cl.
CPC ..... *H04S 7/303* (2013.01); *H04R 5/023* (2013.01)

(58) Field of Classification Search
CPC ..... H04S 7/303; H04R 5/02; H04R 5/023
(Continued)

(56) References Cited

U.S. PATENT DOCUMENTS

2006/0023890 A1 2/2006 Kaminuma
2006/0083394 A1* 4/2006 McGrath ..... H04S 3/00 381/309

(Continued)

FOREIGN PATENT DOCUMENTS

CN 1778143 A 5/2006
CN 101150890 A 3/2008

(Continued)

OTHER PUBLICATIONS

International Search Report and Written Opinion and English translations thereof dated Feb. 12, 2019 in connection with International Application No. PCT/JP2018/044214.

(Continued)

*Primary Examiner* — William A Jerez Lora
(74) *Attorney, Agent, or Firm* — Wolf, Greenfield & Sacks, P.C.

(57) ABSTRACT

An acoustic processing apparatus includes an acquisition section that acquires operation position information of a seat apparatus that operates following a movement of a user; and a sound image localization processor that performs sound image localization processing on an audio signal according to the operation position information acquired by the acquisition section, the audio signal being reproduced by a speaker unit provided to the seat apparatus.

11 Claims, 7 Drawing Sheets

(58) Field of Classification Search
USPC ..... 381/1, 56, 58, 59, 310
See application file for complete search history.

(56) References Cited

U.S. PATENT DOCUMENTS

| | | | | |
|---|---|---|---|---|
| 2006/0274901 | A1* | 12/2006 | Terai | H04S 1/005 381/17 |
| 2010/0053210 | A1 | 3/2010 | Kon | |
| 2011/0170721 | A1 | 7/2011 | Dickins et al. | |
| 2017/0105540 | A1 | 4/2017 | Jacobs et al. | |
| 2020/0367005 | A1 | 11/2020 | Itabashi et al. | |

FOREIGN PATENT DOCUMENTS

| | | | |
|---|---|---|---|
| JP | H04-35615 | A | 2/1992 |
| JP | H0537994 | * | 5/1993 |
| JP | H07-241000 | A | 9/1995 |
| JP | 2003-111200 | A | 4/2003 |
| JP | 2006-050072 | A | 2/2006 |
| JP | 2013176170 | A | 9/2013 |

OTHER PUBLICATIONS

International Preliminary Report on Patentability and English translation thereof dated Aug. 13, 2020 in connection with International Application No. PCT/JP2018/044214.

International Search Report and Written Opinion dated Dec. 18, 2018 in connection with International Application No. PCT/JP2018/039658, and English translation thereof.

International Preliminary Report on Patentability dated Jul. 23, 2020 in connection with International Application No. PCT/JP2018/039658, and English translation thereof.

* cited by examiner

ACOUSTIC PROCESSING APPARATUS, ACOUSTIC PROCESSING METHOD, AND PROGRAM

CROSS-REFERENCE TO RELATED APPLICATIONS

This application claims the benefit under 35 U.S.C. § 371 as a U.S. National Stage Entry of International Application No. PCT/JP2018/044214, filed in the Japanese Patent Office as a Receiving Office on Nov. 30, 2018, which claims priority to Japanese Patent Application Number JP2018-012636, filed in the Japanese Patent Office on Jan. 29, 2018, each of which is hereby incorporated by reference in its entirety.

TECHNICAL FIELD

The present disclosure relates to an acoustic processing apparatus, an acoustic processing method, and a program.

BACKGROUND ART

A chair is known that includes a speaker unit that reproduces (outputs) sound. For example, Patent Literature 1 indicated below discloses an acoustic processing apparatus capable of localizing, at a specified position, a sound image of sound reproduced by such a speaker unit.

CITATION LIST

Patent Literature

Patent Literature 1: Japanese Patent Application Laid-open No. 2003-111200

DISCLOSURE OF INVENTION

Technical Problem

In this field, it is desired to prevent a user who is listening to sound from feeling strange due to a deterioration in a performance of sound image localization.

Therefore, it is an object of the present disclosure to provide an acoustic processing apparatus, an acoustic processing method, and a program that prevent a deterioration in a performance of sound image localization to prevent a user from feeling strange.

Solution to Problem

For example, the present disclosure is an acoustic processing apparatus that includes an acquisition section that acquires operation position information of a seat apparatus that operates following a movement of a user; and a sound image localization processor that performs sound image localization processing on an audio signal according to the operation position information acquired by the acquisition section, the audio signal being reproduced by a speaker unit provided to the seat apparatus.

For example, the present disclosure is an acoustic processing method that includes acquiring, by an acquisition section, operation position information of a seat apparatus that operates following a movement of a user; and performing, by a sound image localization processor, sound image localization processing on an audio signal according to the operation position information acquired by the acquisition section, the audio signal being reproduced by a speaker unit provided to the seat apparatus.

For example, the present disclosure is a program that causes a computer to perform an acoustic processing method that includes acquiring, by an acquisition section, operation position information of a seat apparatus that operates following a movement of a user; and performing, by a sound image localization processor, sound image localization processing on an audio signal according to the operation position information acquired by the acquisition section, the audio signal being reproduced by a speaker unit provided to the seat apparatus.

For example, the present disclosure is an acoustic processing apparatus that includes an acquisition section that acquires operation position information of a seat apparatus that operates following a movement of a user; and a sound image localization processor that performs sound image localization processing on an audio signal according to the operation position information acquired by the acquisition section, the audio signal being reproduced by a speaker unit provided to the seat apparatus, the sound image localization processor including a filtering processor and a transaural system filter section, the filtering processor localizing a sound image at a position at which a virtual speaker is arranged, the position being different from a position of the speaker unit, the transaural system filter section performing transaural processing on the audio signal output from the speaker unit.

Advantageous Effects of Invention

At least an embodiment of the present disclosure makes it possible to prevent a user from feeling strange due to a deterioration in a performance of sound image localization. Note that the effect described here is not necessarily limitative, and any of the effects described in the present disclosure may be provided. Further, contents of the present disclosure are not to be construed as being limited due to the illustrated effects.

MODE(S) FOR CARRYING OUT THE INVENTION

Figure 1:
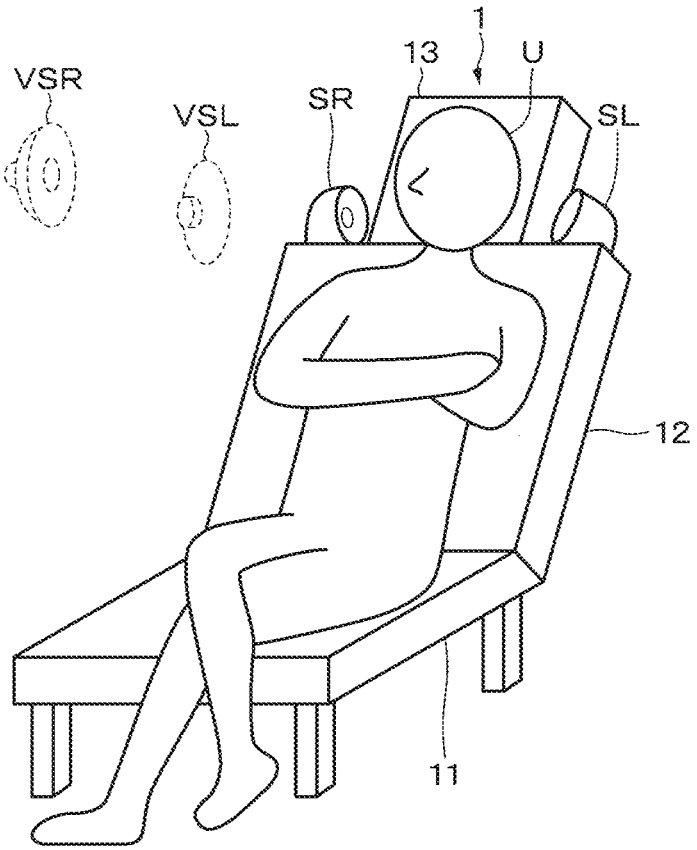
FIG. 1 schematically illustrates, for example, a configuration example of a seat apparatus according to an embodiment.

Embodiments and the like of the present disclosure will now be described below with reference to the drawings. Note that the description is made in the following order.

<1. Embodiment>

<2. Modifications>

The embodiments and the like described below are favorable specific examples of the present disclosure, and contents of the present disclosure are not limited to these embodiments and the like.

1. Embodiment

[Outline of Embodiment]

First, an outline of an embodiment is described with reference to FIG. 1. Reference numeral 1 in FIG. 1 indicates a seat apparatus according to the embodiment. A seat apparatus 1 may be any seat or the like such as a seat of an automobile, an airplane, or a train, a chair used at home, and a seat in a movie theater or an amusement facility. The seat apparatus 1 includes, for example, a seat 11 that is a portion in which a user U sits down, a backrest 12 that is a portion against which the user U leans back, and a headrest 13 that is a portion supporting the head of the user U.

The seat apparatus 1 operates following a movement of the user U. For example, when the user U shifts his/her weight backward in a state of having his/her back against the backrest 12 while releasing a locking mechanism (not illustrated), the backrest 12 reclines. As described above, the seat apparatus 1 is configured such that the angle of the backrest 12 can be changed, that is, such that the seat apparatus 1 is capable of reclining.

Speaker units SL and SR, actual speaker units, are respectively provided at both ends of a top of the backrest 12 (an uppermost portion of the backrest 12). The speaker units SL and SR are provided such that a direction of outputting sound is oriented toward the ears of the user U.

Sounds corresponding to two-channel audio signals are reproduced by the speaker units SL and SR. Specifically, a sound corresponding to an audio signal of a left (L) channel is reproduced by the speaker unit SL. A sound corresponding to an audio signal of a right (R) channel is reproduced by the speaker unit SR. Note that the sounds that correspond to the audio signals and are reproduced by the speaker units SL and SR may be any sound such as a voice of a person, music, or sound of nature.

In the present embodiment, by processing using an acoustic processing apparatus described later being performed, sounds respectively reproduced by the speaker units SL and SR are heard as if the sounds were respectively reproduced to be output from positions of virtual speaker units VSL and VSR illustrated in dotted lines in FIG. 1. In other words, sound images of the sounds reproduced by the speaker units SL and SR are localized such that the user U feels as if the sound images were reproduced by the virtual speaker units VSL and VSR.

[Problem to be Discussed in Embodiment]

Next, a problem to be discussed in the case of a reclinable seat apparatus such as the seat apparatus 1 according to the present embodiment, is described.

The relative positional relationship between an ear E1 of the user U and a speaker unit is changed according to the reclining angle of the backrest 12. This point is described with reference to A to D of FIG. 2. Note that A to D of FIG. 2 schematically illustrates the position of the speaker unit SL.

Figure 2:
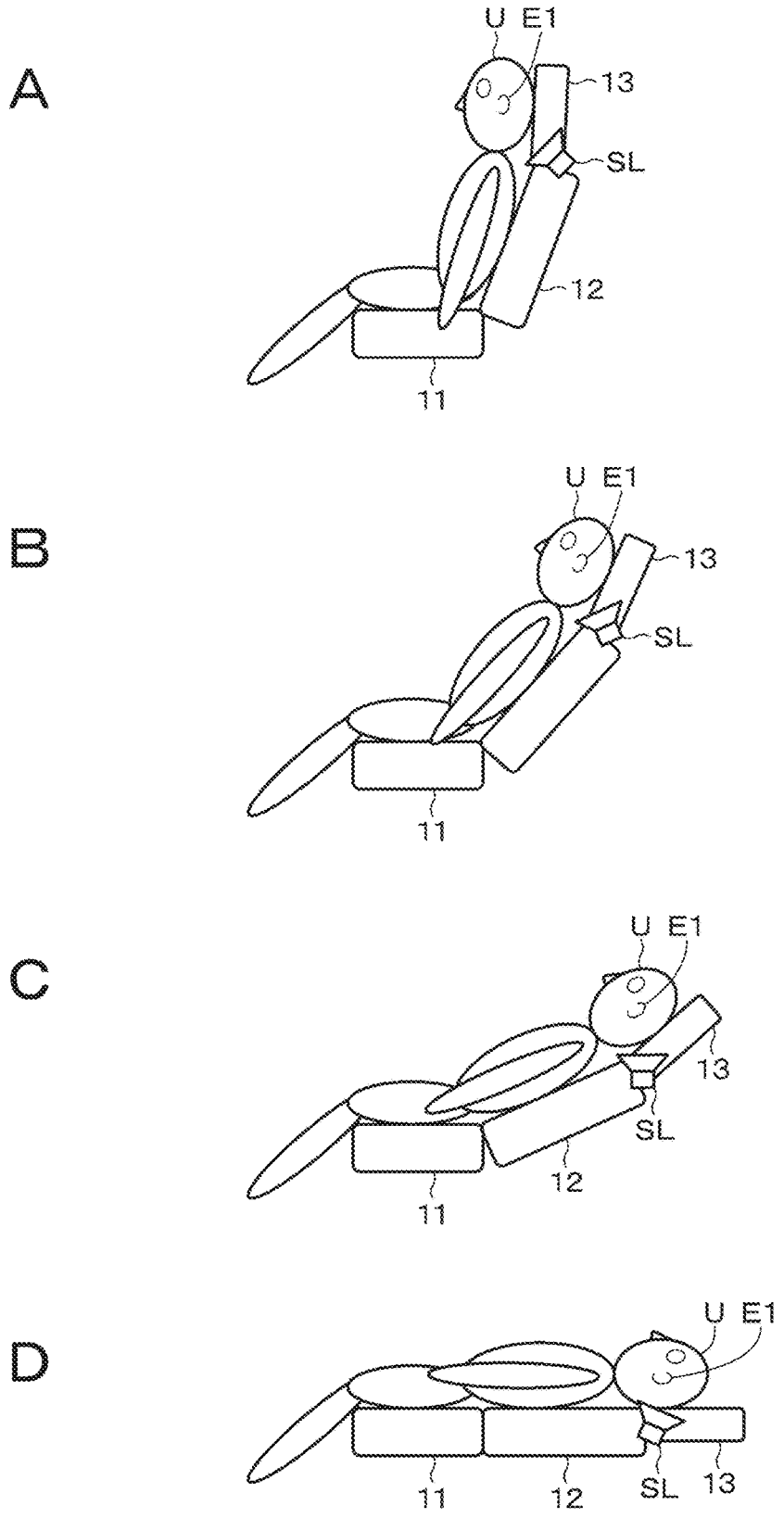
FIG. 2 is a diagram for describing the fact that the relative position of a speaker unit and an ear is changed according to a change in the reclining angle of the seat apparatus.

For example, it is assumed that the user U brings his/her back into contact with the backrest 12 and brings the back of his/her head into contact with the headrest 13, as illustrated in A of FIG. 2. The state illustrated in A of FIG. 2 is a state in which the backrest 12 is most upright (the angle formed by the seat 11 and the backrest 12 is substantially 90 degrees). In the following description, the position of the backrest 12 in this state is referred to as a reference position as appropriate.

B, C, and D of FIG. 2 respectively illustrate states in which the backrest 12 is gradually tilted backward from the reference position. Specifically, the state illustrated in B of FIG. 2 indicates a state in which the backrest 12 is tilted about 30 degrees from the reference position, the state illustrated in C of FIG. 2 indicates a state in which the backrest 12 is tilted about 60 degrees from the reference position, and the state illustrated in D of FIG. 2 indicates a state in which the backrest 12 is tilted about 90 degrees from the reference position.

As illustrated in A to D of FIG. 2, the relative positional relation between the ear E1 of the user U and a speaker unit is changed according to the angle of the backrest 12. For example, the position of a sound outputting surface of the speaker unit SL with respect to the ear E1, or the distance of the sound outputting surface of the speaker unit SL to the ear E1 is changed. Although FIG. 2 only illustrates the speaker unit SL, the same applies to the speaker unit SR.

The change in the relative positional relationship between the ear E1 of the user U and a speaker unit occurs due to various factors. For example, the change in the positional relationship described above occurs, for example, due to a difference in an angle formed by the backrest 12 and a fulcrum of the lower back of the user U, or by the backrest 12 and a virtual axis that vertically extends from the fulcrum; or due to sliding of the buttocks of the user U on the seat 11 that may occur when the backrest 12 reclines.

For example, processing is performed on an audio signal such that a sound image is localized at a specified position when the backrest 12 is in the reference position, as illustrated in A of FIG. 2. However, there is a possibility that, due to the above-described change in the relative positional relationship between the ear E1 of the user U and a speaker unit, a sound image will not be localized at an intended position to cause a deterioration in a performance of sound image localization, and this will result in causing the user U to feel strange. The embodiment of the present disclosure is described in more detail taking into consideration the points described above.

[Configuration Example of Acoustic Reproduction System]

Figure 3:
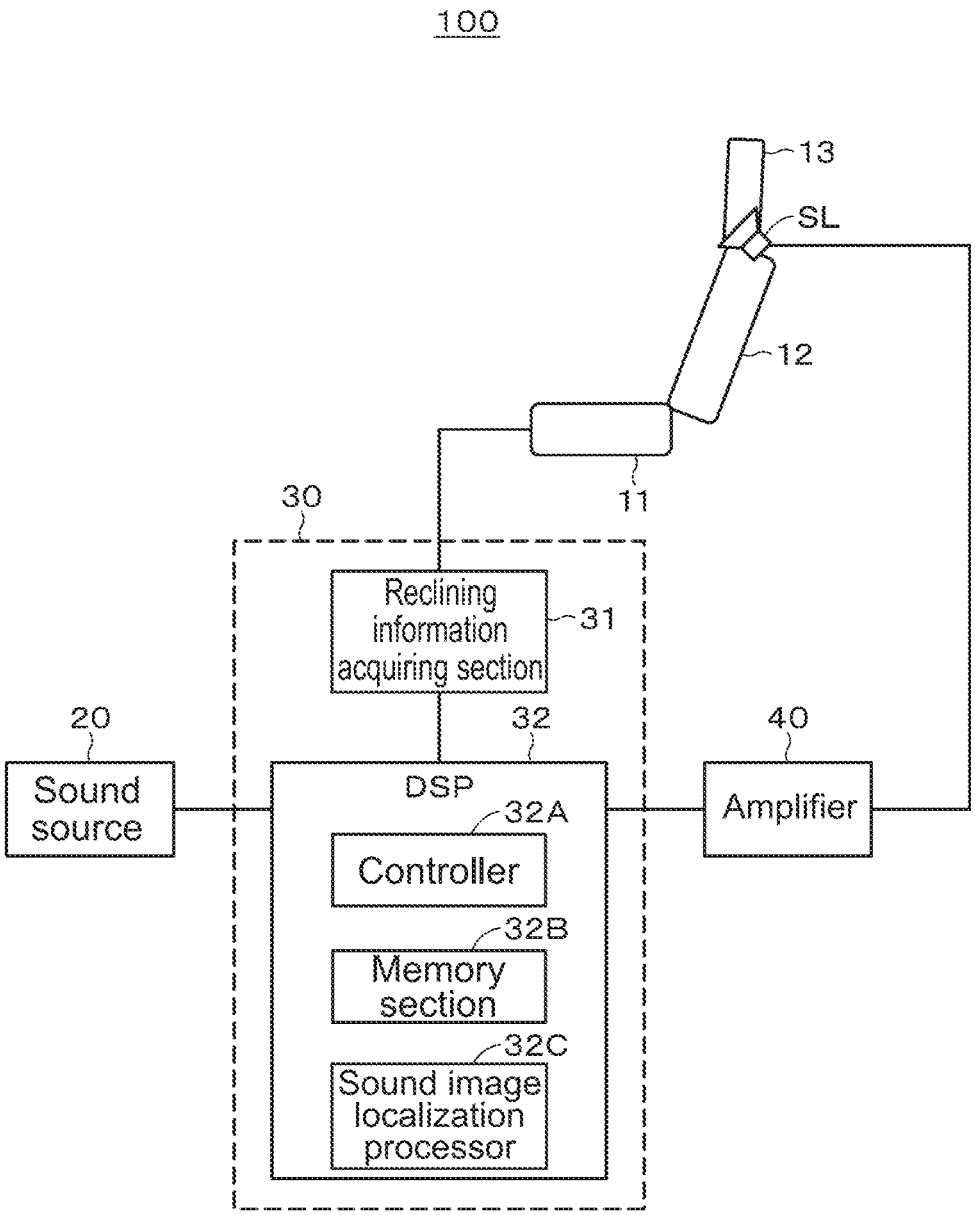
FIG. 3 is a block diagram illustrating a configuration example of an acoustic reproduction system according to the embodiment.

FIG. 3 is a block diagram illustrating a schematic configuration example of an acoustic reproduction system (an acoustic reproduction system 100) according to the embodiment. The acoustic reproduction system 100 includes, for example, a sound source 20, an acoustic processing apparatus 30, and an amplifier 40.

The sound source 20 is a source that supplies an audio signal. The sound source 20 is, for example, a recording medium such as a compact disc (CD), a digital versatile disc (DVD), Blu-ray Disc (BD) (registered mark), or a semiconductor memory. The sound source 20 may be an audio signal supplied via a network such as broadcast or the Internet, or may be an audio signal stored in an external apparatus such as a smartphone or a portable audio player. For example, two-channel audio signals are supplied to the acoustic processing apparatus 30 by the sound source 20.

The acoustic processing apparatus 30 includes, for example, a reclining information acquiring section 31 that is an example of an acquisition section, and a digital signal processor (DSP) 32. The reclining information acquiring section 31 acquires reclining information that indicates the angle of the backrest 12 and is an example of operation position information of the seat apparatus 1. FIG. 3 illustrates an example in which the reclining information is supplied from the seat apparatus 1 to the reclining information acquiring section 31 by wire, but the reclining information may be supplied through a wireless communication (such as a wireless local area network (LAN), Bluetooth (registered trademark), or Wi-Fi (registered trademark), infrared light). Of course, the reclining information acquiring section 31 may directly acquire the reclining angle from a physical position of the backrest 12.

The DSP 32 performs various digital signal processes on an audio signal supplied by the sound source 20. The DSP 32 includes an analog-to-digital (A/D) conversion function, a D/A conversion function, a function that uniformly adjusts (changes) a sound pressure level of an audio signal (a volume adjustment function), a function that corrects the frequency characteristics of an audio signal, and a function that compresses a sound pressure level when the sound pressure level exhibits a value not less than a limit value, such that the sound pressure level exhibits a value less than the limit value. The DSP 32 according to the present embodiment includes a controller 32A, a memory section 32B, and a sound image localization processor 32C that performs processing and the like (described in detail later) with respect to an audio signal such that a sound image is localized at a specified position. The DSP 32 converts, into an analog audio signal, an audio signal on which digital signal processing has been performed, and supplies the analog audio signal to the amplifier 40.

The amplifier 40 amplifies an analog audio signal supplied by the acoustic processing apparatus 30 with a specified amplification factor. Amplified two-channel audio signals are respectively supplied to the speaker units SL and SR, and sound corresponding to the audio signals is reproduced.

[Configuration Example of Sound Image Localization Processor]

Figure 4:
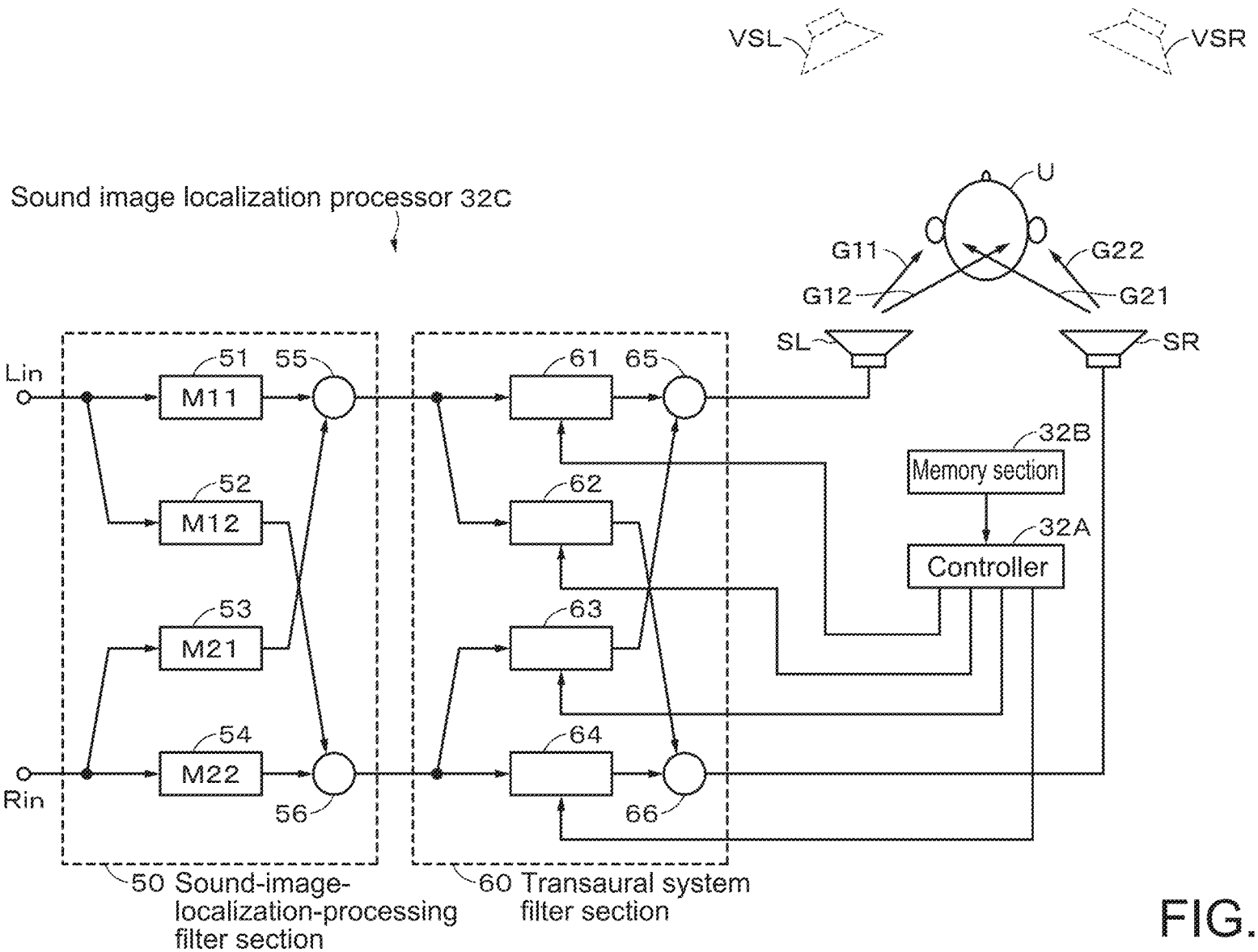
FIG. 4 illustrates a configuration example of a sound image localization processor according to the embodiment.

FIG. 4 is a block diagram illustrating, for example, a configuration example of the sound image localization processor 32C. As described above, the acoustic processing apparatus 30 is supplied with two-channel audio signals. Thus, as illustrated in FIG. 4, the sound image localization processor 32C includes a left channel input terminal Lin that receives supply of an audio signal of a left channel, and a right channel input terminal Rin that receives supply of an audio signal of a right channel.

Then, as illustrated in FIG. 4, the sound image localization processor 32C according to the present embodiment includes, for example, a sound-image-localization-processing filter section 50, and a transaural system filter section 60. The sound image localization processor 32C performs sound image localization processing that includes processing performed by the sound-image-localization-processing filter section 50 and processing performed by the transaural system filter section 60.

Figure 5:
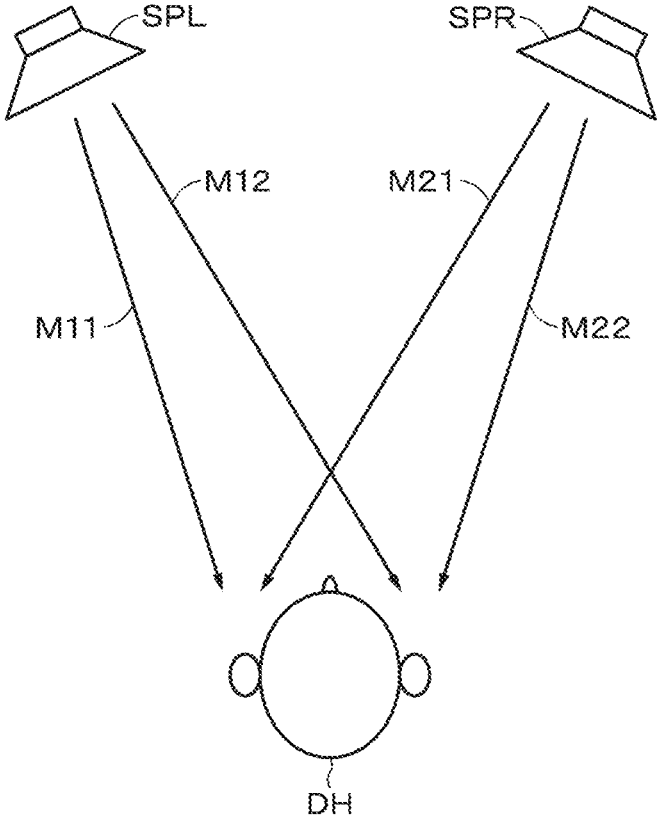
FIG. 5 is a diagram for describing an example of a transfer function of a sound from an actually arranged speaker unit to a dummy head.

The respective sections of the sound image localization processor 32C are described in detail below. First, a principle of the sound image localization processing is described before the sound-image-localization-processing filter section 50 is described. FIG. 5 is a diagram for describing the principle of the sound image localization processing.

As illustrated in FIG. 5, a position of a dummy head DH is assumed to be the position of a user in a specified reproduction sound field. A left actual speaker SPL and a right actual speaker unit SPR are respectively actually provided at left and right virtual speaker positions at which sound images are to be localized (the positions assumed to be the positions of the speakers) relative to the user who is in the position of the dummy head DH.

Next, both ear portions of the dummy head DH collect sounds reproduced by the left actual speaker SPL and the right actual speaker SPR, and transfer functions (also called head-related transfer functions) (HRTFs) are measured in advance. The transfer functions (HRTFs) represent how the sounds reproduced by the left actual speaker SPL and the right actual speaker SPR are changed when the sounds reach both of the ear portions of the dummy head DH.

As illustrated in FIG. 5, in the present embodiment, M11 is a transfer function of a sound from the left actual speaker SPL to the left ear of the dummy head DH, and M12 is a transfer function of a sound from the left actual speaker SPL to the right ear of the dummy head DH. Likewise, M21 is a transfer function of a sound from the right actual speaker SPR to the left ear of the dummy head DH, and M22 is a transfer function of a sound from the right actual speaker SPR to the right ear of the dummy head DH.

In this case, audio signals of sounds reproduced by the speaker units SL and SR of the headrest 13 are processed using transfer functions measured in advance, as described above with reference to FIG. 5, the speaker units SL and SR of the headrest 13 being situated near the ears of the user. Then, sounds of the processed audio signals are reproduced.

This makes it possible to localize sound images of sounds reproduced by the speaker units SL and SR of the headrest 13 such that the user feels as if the sounds reproduced by the speaker units SL and SR were reproduced to be output from virtual speaker positions (the positions of the virtual speaker units VSL and VSR in FIGS. 1 and 4).

Note that, here, the dummy head DH has been used to measure a transfer function (HRTF). However, the present technology is not limited thereto. It is also possible to measure a transfer function of a sound while a person actually sits down in the reproduction sound field for measuring a transfer function and microphones are placed near his/her ears. The localization position of a sound image is not limited to two positions on the left and right, and, for example, five positions (positions for a five-channel-based acoustic reproduction system (specifically, center, front left, front right, rear left, and rear right)) may be adopted. In this case, transfer functions of a sound from an actual speaker placed at each position to both of the ears of the dummy head DH are obtained. The position at which a sound image is localized may be set on a ceiling (situated above the dummy head DH).

As described above, the sound-image-localization-processing filter section 50 illustrated in FIG. 4 is a portion that performs processing using a transfer function of a sound that is measured in advance, in order to localize a sound image at a specified position. The sound-image-localization-processing filter section 50 according to the present embodiment is capable of processing two-channel audio signals of left and right channels, and includes four filters 51, 52, 53, and 54 and two adders 55 and 56, as illustrated in FIG. 4.

The filter 51 processes, using the transfer function M11, an audio signal of the left channel that is supplied through the left channel input terminal Lin, and supplies the processed audio signal to the adder 55 for the left channel. Further, the filter 52 processes, using the transfer function M12, an audio signal of the left channel that is supplied through the left channel input terminal Lin, and supplies the processed audio signal to the adder 56 for the right channel.

Further, the filter 53 processes, using the transfer function M21, an audio signal of the right channel that is supplied through the right channel input terminal Rin, and supplies the processed audio signal to the adder 55 for the left channel. Furthermore, the filter 54 processes, using the transfer function M22, an audio signal of the right channel that is supplied through the right channel input terminal Rin, and supplies the processed audio signal to the adder 56 for the right channel.

This results in localizing sound images such that a sound of an audio signal output from the adder 55 for the left channel is reproduced by the virtual speaker unit VSL, and a sound image of a sound of an audio signal output from the adder 56 for the right channel is reproduced by the virtual speaker unit VSR.

However, there is a possibility that, even if sound image localization processing is performed by the sound-image-localization-processing filter section 50 on sounds reproduced by the speaker units SL and SR that are provided to the headrest 13, a sound image of reproduction sound will not be accurately localized at a target virtual-speaker-unit position due to the influence of the transfer functions G11, G12, G21, and G22 in the actual reproduction sound field, as illustrated in FIG. 4.

Therefore, in the present embodiment, by processing using the transaural system filter section 60 being performed on an audio signal output from the sound-image-localization-processing filter section 50, sounds reproduced by the speaker units SL and SR are accurately localized as if the sounds were reproduced by the virtual speaker units VSL and VSR.

The transaural system filter section 60 is a sound filter (for example, a finite impulse response (FIR) filter) to which a transaural system is applied. The transaural system is a technology that provides effects similar to the effects provided by a binaural system even when speaker units are used. The binaural system is a method for precisely reproducing sound using headphones.

The transaural system is described with reference to the example of FIG. 4. Sounds reproduced by the speaker units SL and SR are precisely reproduced by canceling the influence of the transfer functions G11, G12, G21, and G22, the transfer functions G11 and G12 being functions of sounds from the speaker unit SL to the left ear and the right ear of the user, the transfer functions G21 and G22 being functions of sounds from the speaker unit SR to the left ear and the right ear of the user.

Therefore, by canceling the influence of transfer functions in the reproduction sound field with respect to sounds to be reproduced by the speaker units SL and SR, the transaural system filter section 60 illustrated in FIG. 4 accurately localizes sound images of sounds reproduced by the speaker units SL and SR at positions corresponding to the virtual-speaker-unit positions.

Specifically, in order to cancel the influence of the transfer functions of the sounds from the speaker units SL and SR to the left ear and the right ear of the user U, the transaural system filter section 60 includes filters 61, 62, 63, and 64 and adders 65 and 66 that are used to process an audio signal depending on inverse functions of the transfer functions of a sound from the speaker unit SR to the left ear and the right ear of the user U. Note that, in the present embodiment, processing is performed in the filters 61, 62, 63, and 64 taking inverse filter characteristics into consideration, and this results in being able to reproduce more natural reproduction sound.

[Operation Example of Acoustic Processing Apparatus]

As described above, the relative positional relationship between the ear E1 of the user U and a speaker unit is changed according to a change in the reclining angle of the backrest 12. Therefore, the transfer functions of sounds from the speaker units SL and SR to the ear E1 of the user U vary.

Therefore, coefficient data used for each of the filters 61, 62, 63, and 64 of the transaural system filter section 60 is stored in the memory section 32B in advance in order to cancel the influence of a transfer function. The coefficient data is stored for each reclining angle.

Then, at the time of reproducing sound, the controller 32A reads, from the memory section 32B, coefficient data for each filter that corresponds to reclining information acquired by the reclining information acquiring section 31. The controller 32A sets the coefficient data read from the memory section 32B for each of the filters of the transaural system filter section 60. This enables the transaural system filter section 60 to perform appropriate processing (transaural processing) depending on the reclining angle of the seat apparatus 1 with respect to an audio signal output from the sound-image-localization-processing filter section 50. A sound image is localized at an intended position by performing such processing. This makes it possible to prevent the user U from feeling strange due to a shift or the like of the localization position of a sound image.

An audio signal output from the adder 55 for the left channel in the sound-image-localization-processing filter section 50 is supplied to the filter 61 for the left channel and the filter 62 for the right channel in the transaural system filter section 60. An audio signal output from the adder 56 for the right channel in the sound-image-localization-processing filter section 50 is supplied to the filter 63 for the left channel and the filter 64 for the right channel in the transaural system filter section 60.

Each of the filters 61, 62, 63, and 64 performs specified processing using a filter coefficient set by the controller 32A. Specifically, the filters of the transaural system filter section 60 form inverse functions of the transfer functions G11, G12, G21, and G22 illustrated in FIG. 4 on the basis of coefficient data set by the controller 32A to process an audio signal. This results in canceling the influence of the transfer functions G11, G12, G21, and G22 in the reproduction sound field.

Then, output from the filter 61 is supplied to the adder 65 for the left channel, and output from the filter 62 is supplied to the adder 66 for the right channel. Likewise, output from the filter 63 is supplied to the adder 65 for the left channel, and output from the filter 64 is supplied to the adder 66 for the right channel.

Then, each of the adders 65 and 66 adds the supplied audio signals. An audio signal output from the adder 65 is amplified by the amplifier 40 (not illustrated in FIG. 4) and then supplied to the speaker unit SL. A sound that corresponds to the audio signal is reproduced by the speaker unit SL. Further, an audio signal output from the adder 66 is amplified by the amplifier 40 (not illustrated in FIG. 4) and then supplied to the speaker unit SR. A sound that corresponds to the audio signal is reproduced by the speaker unit SR.

The influence of transfer functions on sounds reproduced by the speaker units SL and SR is canceled by performing the processing described above, the transfer function corresponding to a current position of the head (more specifically, the ear) of a user in the reproduction sound field. This makes it possible to accurately localize sound images as if the sounds were reproduced by the virtual speaker units VSL and VSR.

[Example of Localization Position of Sound Image]

Figure 6:
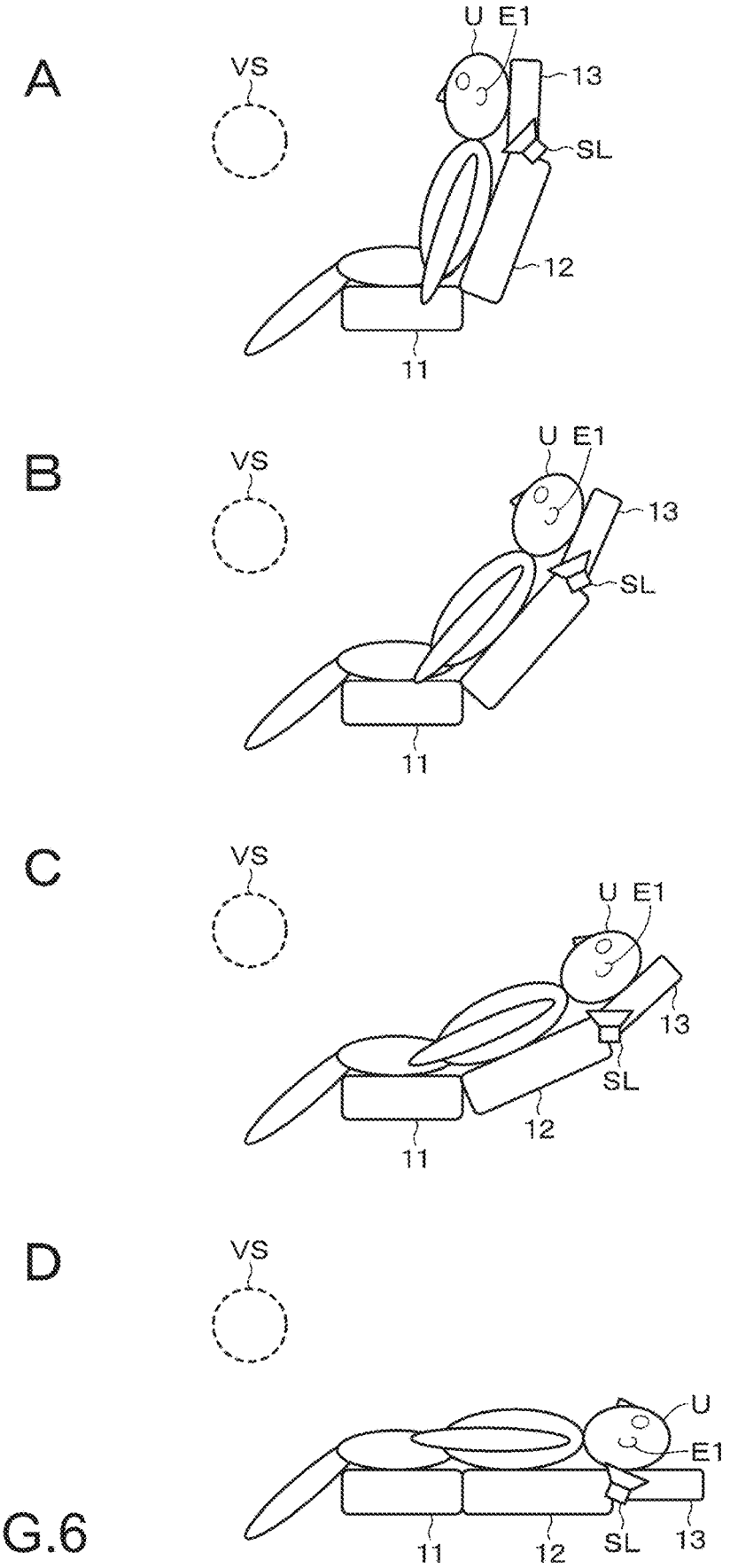
FIG. 6 illustrates an example of a position at which a sound image is localized.

Next, an example of a position at which a sound image is localized is described. For example, the transaural processing is performed such that the sound image localization position is substantially the same even when the seat apparatus 1 reclines following the movement of the user U and the reclining angle is changed, as illustrated in A to D of FIG. 6. Note that, in order to facilitate understanding, FIG. 6 and FIG. 7 described later each schematically illustrate a position at which a sound image is to be localized, using a single sound image (a dotted circle). However, there exist two positions at which a sound image is to be localized, for example, when a two-channel-based sound reproduction system is used.

For example, the position of a sound image VS is set in a front direction of the user U when the user U is seated on the seat apparatus 1 in the reference position. It is possible to perform such an operation by changing coefficient data set for the filters 51, 52, 53, and 54 even when the reclining angle is changed. Note that substantially the same means that a change in the position of a sound image with respect to the user U is acceptable if the user U hardly recognizes the change in the position of a sound image.

Note that, since the relative position of the ear E1 of the user U and the speaker unit SL, SR is changed according to a change in the reclining angle, processing of setting, for the filter 61 and the like, coefficient data corresponding to reclining information indicating the reclining angle is performed similarly to the processing described above.

A mode in which the position of the sound image VS is not substantially changed is favorable, for example, when sound is reproduced in synchronization with a video in the front direction of the user U being seated on the seat apparatus 1 in the reference position. In other words, when the position of the sound image VS is changed, the sound image is localized at a position away from a reproduction position of the video, and sound is heard from the position at which the sound image is localized. This results in separating the video and the sound and causing the user U to feel strange. However, it is possible to avoid such a problem by not substantially changing an absolute position of the sound image VS.

Figure 7:
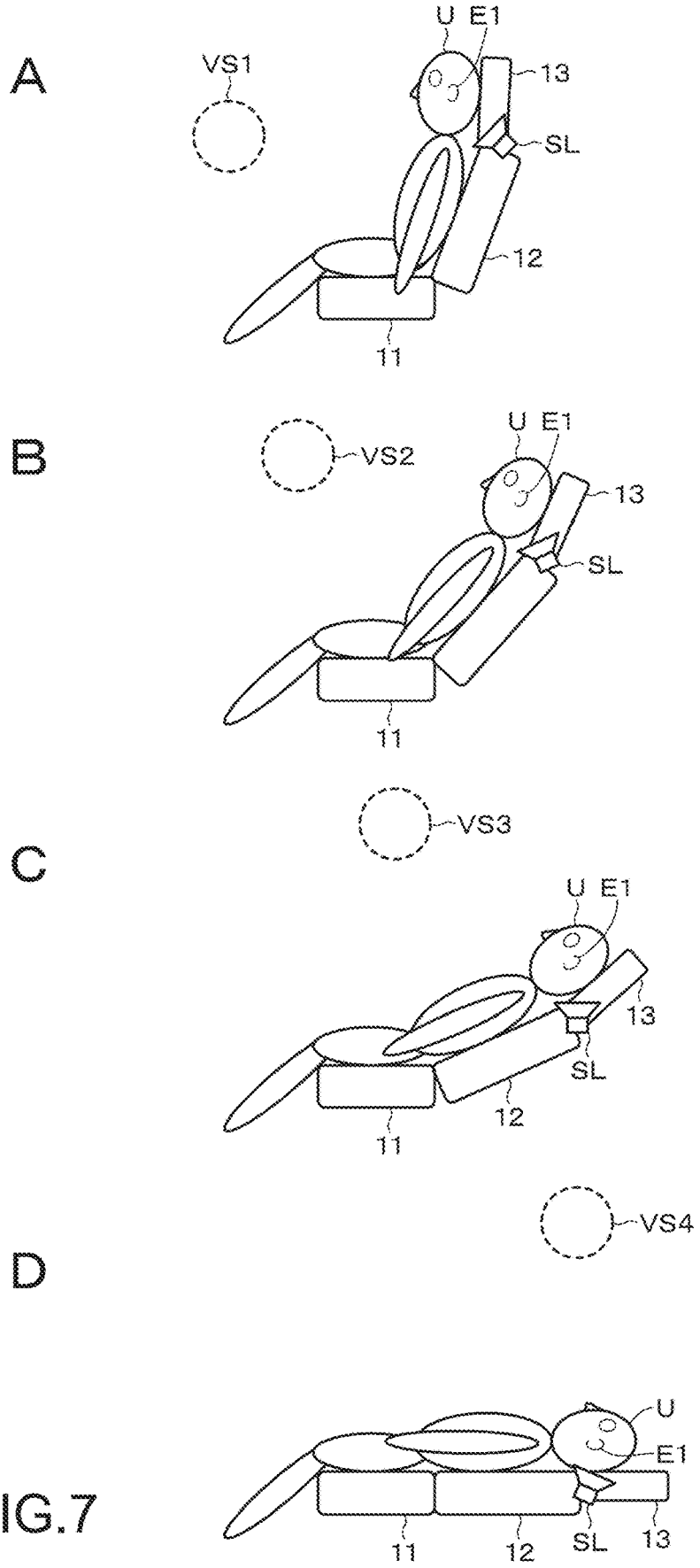
FIG. 7 illustrates another example of the position at which a sound image is localized.

Further, the transaural processing may be performed such that the relative position of a sound image with respect to the user U is also substantially the same even when the reclining angle is changed, as illustrated in A to D of FIG. 7. For example, the processing is performed such that a sound image is localized substantially in front of the user U even when the reclining angle is changed and the user U lies down.

In A to D of FIG. 7, positions for respective reclining angles at which a sound image is to be localized are respectively indicated using VS1, VS2, VS3, and VS4. Then, an actual speaker is arranged at each of the positions (VS1 to VS4) at which a sound image is to be localized, and transfer functions (HRTFs) that represent how sounds reproduced by the actual speakers are changed when the sounds reach both of the ear portions of the dummy head DH are measured in advance. Then, audio signals reproduced by the speaker units SL and SR are processed using a transfer function that corresponds to the reclining angle and is measured in advance, and sound of the processed audio signal is reproduced. Such an operation is favorable, for example, when only reproduction of sound (without a video) is performed. It is also possible to constantly localize a sound image in the front direction of the user U when the user U is relaxed to lie down. Of course, it is not necessary to arrange an actual speaker to perform measurement for each reclining angle, and a transfer function (HRTF) when the user U is seated on the prepared seat position 1 in the reference position may be used.

Note that the relative position of the ear E1 of the user U and the speaker unit SL, SR is changed according to a change in the reclining angle. Thus, even when there is a change in the reclining angle, it is possible to perform processing of setting, for the filter 61 and the like, coefficient data corresponding to reclining information indicating the reclining angle by changing coefficient data set for the filters 61, 62, 63, and 64.

Of course, the position at which a sound image is localized is not limited to these patterns, and may be set as appropriate according to the application to which the acoustic processing apparatus 30 is applied.

2. Modifications

Although the embodiment of the present disclosure has been specifically described above, contents of the present disclosure are not limited to the embodiment described above, and various modifications based on technical ideas of the present disclosure may be made thereto.

In the embodiment described above, coefficient data set for the filters 61, 62, 63, and 64 according to the reclining angle may be data according to the characteristics (the physical characteristics) of the user U. For example, the position of the ear E1 varies depending on the size of the face, the size of the neck, the sitting height, and the like of the user U. Therefore, when the controller 32A sets coefficient data corresponding to the reclining angle for the filter 61 and the like, the controller 32A may further read a piece of coefficient data corresponding to the characteristics of the user U from among the coefficient data corresponding to the reclining angle, and may perform correction processing of setting the read piece of coefficient data for the filter 61 and the like. In this case, a piece of coefficient data corresponding to the reclining angle and the characteristics of the user U is stored in the memory section 32B.

The acoustic processing apparatus 30 may include a characteristics acquisition unit that acquires the characteristics of the user U. Examples of the characteristics acquisition section include an image-capturing apparatus and a sensor apparatus. For example, the size of the face, the length of the neck, and the like of the user U may be acquired using the image-capturing apparatus. Further, a pressure sensor may be provided to the backrest 12 or the headrest 13. Using the pressure sensor, a portion with which the back of the head is brought into contact may be detected to estimate the position of the ear E1 from the detected portion, and coefficient data corresponding to the estimated position of the ear E1 may be set for the filter 61 and the like. Further, the user U may use his/her characteristics registered with an application used by the user U (such as an application in which his/her height and weight are set for health management).

The seat apparatus 1 according to the embodiment includes the seat 11, the backrest 12, and the headrest 13, but the configuration is not limited to this. The seat apparatus 1 does have to have a configuration in which they are clearly distinguishable from one another, and, for example, the seat, the backrest, and the headrest may be integrally (continuously) formed.

Note that, for example, the seat 11 may move in the front-rear direction depending on the structure of the seat apparatus 1. The relative position of the ear E1 of the user U and the speaker unit SL, SR may be changed due to a change in the pose of the user U that occurs depending on the movement of the seat 11. Therefore, operation position information of the seat apparatus 1 may be position information of the seat 11, and, according to the position information of the seat 11, switching may be performed between filters (a coefficient set for a filter may be changed), as described in the embodiment. Further, the seat apparatus 1 may have a structure in which the angle of the backrest 12 is changed in conjunction with the movement of the seat 11 in the front-rear direction. When the seat apparatus 1 has such a structure, the reclining information acquiring section 31 may acquire the position information of the seat 11 to estimate reclining information indicating the angle of the backrest 12 on the basis of the position information.

In the embodiment described above, coefficient data set for the filter 61 and the like may be measured for each set of positions of a plurality of ears E1 respectively corresponding to a plurality of reclining angles, or, from a piece of coefficient data obtained by performing measurement at a certain point (the ear E1 corresponding to a certain reclining angle), pieces of coefficient data at other points may be predicted. For example, it is possible to perform prediction by accessing a database in which pieces of coefficient data related to other users are stored and by referring to the pieces of coefficient data related to the other users that are stored in the database. Further, a prediction function obtained by modeling a tendency of a position of the ear E1 corresponding to a certain reclining angle may be generated, and pieces of coefficient data at other points may be obtained using the prediction function.

In the embodiment described above, not all of the pieces of coefficient data respectively corresponding to all of the reclining angles have to be stored in the memory section 32B. Only a piece of coefficient data corresponding to a reclining angle that can be set for the seat apparatus 1 may be stored in the memory section 32B. Further, only pieces of coefficient data respectively corresponding to a plurality of typical reclining angles may be stored in the memory section 32B, and pieces of coefficient data respectively corresponding to other reclining angles may be obtained by, for example, interpolating the pieces of coefficient data stored in the memory section 32B.

Instead of being provided to the top of the backrest 12, the speaker units SL and SR may be provided to the inside of the backrest 12, and may be provided such that sound is reproduced to be output from a specified position on a surface with which the back of the user U is brought into contact. Further, instead of being provided to the backrest 12, the speaker units SL and SR may be provided to the headrest 13 (for example, on a lateral surface of the headrest 13). Furthermore, the speaker units SL and SR may be removable from the seat apparatus 1. For example, the configuration may be made such that a speaker unit that the user U usually uses indoors or the like can be attached to a seat apparatus in an automobile.

Instead of being stored in the memory section 32B, coefficient data set for each filter may be stored in a server apparatus or the like with which a connection can be established via a specified network such as the Internet. Then, the acoustic processing apparatus 30 may be capable of acquiring the coefficient data by communicating with the server apparatus or the like. The memory section 32B may be a memory apparatus (for example, a universal serial bus (USB) memory) that is removable from the acoustic processing apparatus 30.

The configurations, methods, steps, shapes, materials, values, and the like described in the embodiments above are merely examples, and different configurations, methods, steps, shapes, materials, values, and the like may be used as necessary. The embodiments and the modifications described above can be combined as appropriate. Further, the present disclosure may be a method, a program, or a medium having stored therein the program. Furthermore, a portion of the processing described in the embodiment above may be performed by an apparatus on a cloud.

The present disclosure may also take the following configurations.

(1) An Acoustic Processing Apparatus, Including:

an acquisition section that acquires operation position information of a seat apparatus that operates following a movement of a user; and a sound image localization processor that performs sound image localization processing on an audio signal according to the operation position information acquired by the acquisition section, the audio signal being reproduced by a speaker unit provided to the seat apparatus.

(2) The Acoustic Processing Apparatus According to (1), in Which according to the operation position information acquired by the acquisition section, the sound image localization processor performs transaural processing on the audio signal output from the speaker unit.

(3) The Acoustic Processing Apparatus According to (1) or (2), in Which the sound image localization processor performs transaural processing such that a sound image localization position is substantially the same even when there is a change in the operation position information.

(4) The Acoustic Processing Apparatus According to (1) or (2), in Which the sound image localization processor performs transaural processing such that a relative position of a sound image with respect to the user is substantially the same even when there is a change in the operation position information.

(5) The Acoustic Processing Apparatus According to any One of (1) to (4), in Which the operation position information of the seat apparatus is reclining information that indicates an angle of a backrest included in the seat apparatus.

(6) The Acoustic Processing Apparatus According to any One of (1) to (5), in which the sound image localization processor performs correction processing depending on characteristics of the user.

(7) The Acoustic Processing Apparatus According to (6), Further Including a characteristics acquisition section that acquires the characteristics of the user.

(8) The Acoustic Processing Apparatus According to any One of (1) to (7), Further Including the speaker unit, in which the speaker unit is provided to a top of a backrest included in the seat apparatus.

(9) The Acoustic Processing Apparatus According to any One of (1) to (8), in Which the sound image localization processor includes a filter.

(10) An Acoustic Processing Method, Including:

acquiring, by an acquisition section, operation position information of a seat apparatus that operates following a movement of a user; and performing, by a sound image localization processor, sound image localization processing on an audio signal according to the operation position information acquired by the acquisition section, the audio signal being reproduced by a speaker unit provided to the seat apparatus.

(11) A Program that Causes a Computer to Perform an Acoustic Processing Method Including:

acquiring, by an acquisition section, operation position information of a seat apparatus that operates following a movement of a user; and performing, by a sound image localization processor, sound image localization processing on an audio signal according to the operation position information acquired by the acquisition section, the audio signal being reproduced by a speaker unit provided to the seat apparatus.

(12) An Acoustic Processing Apparatus, Including:

an acquisition section that acquires operation position information of a seat apparatus that operates following a movement of a user; and a sound image localization processor that performs sound image localization processing on an audio signal according to the operation position information acquired by the acquisition section, the audio signal being reproduced by a speaker unit provided to the seat apparatus, the sound image localization processor including a filtering processor and a transaural system filter section, the filtering processor localizing a sound image at a position at which a virtual speaker is arranged, the position being different from a position of the speaker unit, the transaural system filter section performing transaural processing on the audio signal output from the speaker unit.

REFERENCE SIGNS LIST

1 seat apparatus
12 backrest
31 reclining information acquiring section
32C sound image localization processor
SL, SR speaker unit
E1 ear
61 to 64 filter

The invention claimed is:

1. An acoustic processing apparatus, comprising:

an acquisition section configured to acquire operation position information of a seat apparatus that operates following a movement of a user; and a sound image localization processor configured to perform sound image localization processing on an audio signal according to the operation position information acquired by the acquisition section, the audio signal being reproduced by a speaker unit provided to the seat apparatus, wherein the sound image localization processor includes a sound image localization processing filter and a transaural system filter and wherein the transaural system filter is controlled based on the acquired operation position information of the seat apparatus.

2. The acoustic processing apparatus according to claim 1, wherein according to the operation position information acquired by the acquisition section, the sound image localization processor is configured to perform transaural processing on the audio signal output from the speaker unit.

3. The acoustic processing apparatus according to claim 1, wherein the sound image localization processor is configured to perform transaural processing such that a sound image localization position is substantially the same even when there is a change in the operation position information.

4. The acoustic processing apparatus according to claim 1, wherein the sound image localization processor is configured to perform transaural processing such that a relative position of a sound image with respect to the user is substantially the same even when there is a change in the operation position information.

5. The acoustic processing apparatus according to claim 1, wherein the operation position information of the seat apparatus includes reclining information that indicates an angle of a backrest included in the seat apparatus.

6. The acoustic processing apparatus according to claim 1, wherein the sound image localization processor is configured to perform correction processing depending on characteristics of the user.

7. The acoustic processing apparatus according to claim 6, further comprising a characteristics acquisition section configured to acquire the characteristics of the user.

8. The acoustic processing apparatus according to claim 1, further comprising the speaker unit, wherein the speaker unit is provided to a top of a backrest included in the seat apparatus.

9. An acoustic processing method, comprising:

acquiring, by an acquisition section, operation position information of a seat apparatus that operates following a movement of a user; and performing, by a sound image localization processor, sound image localization processing on an audio signal according to the operation position information acquired by the acquisition section, the audio signal being reproduced by a speaker unit provided to the seat apparatus, wherein the sound image localization processing includes sound image localization filtering and transaural system filtering and wherein the transaural system filtering is based on the acquired operation position information of the seat apparatus.

10. A non-transitory computer readable medium storing instructions that, when executed by a computer, perform an acoustic processing method comprising:

acquiring, by an acquisition section, operation position information of a seat apparatus that operates following a movement of a user; and performing, by a sound image localization processor, sound image localization processing on an audio signal according to the operation position information acquired by the acquisition section, the audio signal being reproduced by a speaker unit provided to the seat apparatus, wherein the sound image localization processing includes sound image localization filtering and transaural system filtering and wherein the transaural system filtering is based on the acquired operation position information of the seat apparatus.

11. An acoustic processing apparatus, comprising:

an acquisition section configured to acquire operation position information of a seat apparatus that operates following a movement of a user; and a sound image localization processor configured to perform sound image localization processing on an audio signal according to the operation position information acquired by the acquisition section, the audio signal being reproduced by a speaker unit provided to the seat apparatus, the sound image localization processor including a filtering processor and a transaural system filter, the filtering processor localizing a sound image at a position at which a virtual speaker is arranged, the position being different from a position of the speaker unit, the transaural system filter performing transaural processing on the audio signal output from the speaker unit, wherein the transaural system filter is controlled based on the acquired operation position information of the seat apparatus.

* * * * *